United States Patent [19]

Tapley

[11] 4,108,651

[45] Aug. 22, 1978

[54] METHOD OF PRODUCING A MULTI-GAGE STRIP OR SHAPE FROM POWDERED METAL

[76] Inventor: Claude D. Tapley, 77 Woodland Dr., Cheshire, Conn. 06410

[21] Appl. No.: 689,675

[22] Filed: May 24, 1976

[51] Int. Cl.[2] ..... B22F 3/18

[52] U.S. Cl. ..... 75/208 CS; 75/214; 75/226; 425/79

[58] Field of Search ..... 75/214, 226, 208 CS; 425/79

[56] References Cited

U.S. PATENT DOCUMENTS

| | | | |
|---|---|---|---|
| 2,917,821 | 12/1959 | Fritsch | 425/79 X |
| 2,922,223 | 1/1960 | Boughton et al. | 75/214 Y |
| 3,266,089 | 8/1966 | Gehring | 425/79 |
| 3,277,527 | 10/1966 | Essers et al. | 425/79 |
| 3,411,197 | 11/1968 | Axenov et al. | 75/208 CS |
| 3,689,209 | 9/1972 | Vinogradov | 425/79 |

*Primary Examiner*—Richard E. Schafer

*Attorney, Agent, or Firm*—De Lio and Montgomery

[57] ABSTRACT

A method of producing a metal strip or shape from powdered metal in which the transverse cross-section of the strip or shape so produced has portions of different thickness, wherein a thick portion is positioned adjacent of a thin portion or thick portions are positioned adjacent to thin portions, and, after proper sintering, the multi-thickness strip is rolled and annealed to reduce the strip's weight per foot, thus developing the required dimensional and mechanical properties.

5 Claims, 6 Drawing Figures

METHOD OF PRODUCING A MULTI-GAGE STRIP OR SHAPE FROM POWDERED METAL

BACKGROUND OF THE INVENTION

The forming of metal strip or shape having controlled multiple thicknesses has previously been accomplished using milling, roll-form reduction, extrusion, or drawing techniques. Milling is a slow operation that consumes excessive energy and generates excessive scrap. Roll-form reduction is limited in respect of the thickness and width ratios that can be achieved. The types and dimensions of cross-sectional configurations that can be extruded and/or drawn are limited. According to this invention, cross-sections now or not now possible with roll-form reduction techniques can be rolled from powdered metals without the scrap generation necessary in a milling technique, and shapes now or not now possible with extrusion and/or drawing techniques can be rolled from powdered metals.

SUMMARY OF THE INVENTION

This invention provides a method of producing a metal strip or shape having multiple thicknesses by feeding metal powder through the nip of a set of rolls with one or both of the rolls having multiple diameters. The amount of powdered metal fed to the various sections of the rolls is metered so that it is essentially proportional to the distances between the rolls at those sections of the nip where uniform density of the compacted powder is required. The feed proportions may be varied when non-uniform density is required. The method of feeding the metal powder, whether from the side or from above the rolls, is not a part of this invention since hoppers to accomplish this are commercially available. The gates and trays in these known mechanisms will be such that proper metal powder proportions are attained and maintained into the roll nip. (U.S. Pat. No. 2,922,223, Boughton et al., shows an adjustable profile gate; U.S. Pat. No. 2,937,942, Lenel, shows a fixed profile gate with replaceable blade.)

The resultant compacted strip has gage ratios so calculated that, after sintering, the percent reduction in all sections will be substantially uniform during subsequent rolling and annealing operations as the required dimensional and mechanical properties are developed. Suitable edge-rolling techniques which are in common industrial use are employed to control edge conditions and are not a part of this invention.

This invention envisions rolling a metal stripe or metal stripes into the surface of the strip with the powder. The stripe or stripes may be but are not limited to gold, gold alloys, silver, silver alloys, tin, tin alloys, lead, lead alloys, zinc, zinc alloys, iron, iron alloys, copper, and copper alloys.

The metal powders used in the practice of this invention may be but are not limited to copper, copper alloys, zinc, zinc alloys, iron, iron alloys, nickel, nickel alloys, tin, tin alloys, lead, lead alloys, tungsten, tungsten alloys, molybdenum, and combinations of these metals.

It is an object of the invention to provide a method of producing a metal strip or shape in which the transverse cross-section has portions of different thickness, the method involving the rolling of powdered metal and being adaptable to the manufacture of strips or shapes wherein the distribution and dimensions of the thick and thin portions are not subject to limitations heretofore existing.

It is another object of the invention to provide such a method wherein the need for trimming or otherwise producing scrap or waste material is eliminated or minimized.

It is a further object of the invention to provide such a method wherein a wide variety of metals and/or alloys can be used.

The invention accordingly comprises the several steps and the relation of one or more of such steps with respect to each of the others thereof, which will be exemplified in the method hereinafter disclosed, and the scope of the invention will be indicated in the claims.

Apparatus adapted for use in carrying out the method is shown somewhat diagrammatically in the accompanying drawing, wherein.

Figure 3:
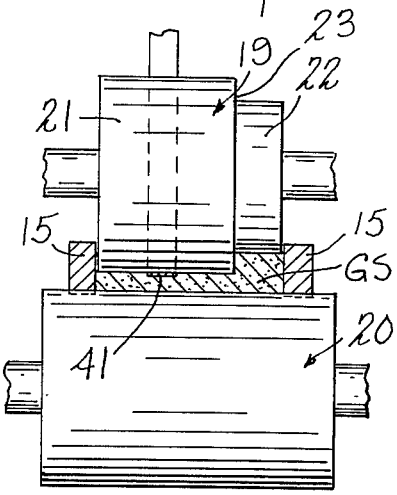
FIG. 3 represents a transverse vertical section on the line III—III of FIG. 1.
Figure 6:
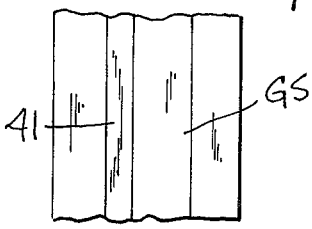
FIG. 6 represents a plan view of a piece of metal strip having a stripe of a different metal rolled. thereon.

Referring to the drawing, the bin or hopper 11, containing a suitable metal powder P, is provided with metering gates indicated generally at 12, arranged to feed the powder onto an inclosed tray 13 having a bottom 14, sides 15, a longitudinal divider 16 and a lower edge 17. The inclination of the tray is such that the metal powder flows by gravity to the nip of compacting rolls 19 and 20, the roll 19 being shown as having a larger diameter portion 21 and a smaller diameter portion 22 separated by the annular wall 23 lying in a plane perpendicular to the axis of the roll, while roll 20 is cylindrical and may suitably be wider than roll 19, as shown in FIG. 3. The wall 23 may be angled to form a beveled surface between the different diameter portions, if desired.

The lower edge 17 of the tray 13 is preferably located close to the surface of roll 20 at a point at or near the nip of the rolls, and the tray sides 15 extend past the nip on each side of the roll 19, substantially closing the nip of the rolls laterally, in the zone of greatest compression, where the powder is compacted to form a green strip GS.

The green strip may be given an additional roll pass between the rolls 25 and 26, similar to rolls 19 and 20, but spaced to compress and increase the density of the green strip before it enters the sintering furnace 27 where it is heated to a proper temperature for a suitable time, depending on the specific metal powder being used.

The complete method includes the steps of running the sintered strip through one or more pairs of post-sintering rolls 30, 31 and delivering the product to a take-up reel 33 for storage or transportation to a point of utilization. The steps of the method may conveniently be carried out in-line, as shown, or the compacted and rolled green strip may be stored or transported to a remotely located sintering furnace for further processing.

Figure 1:
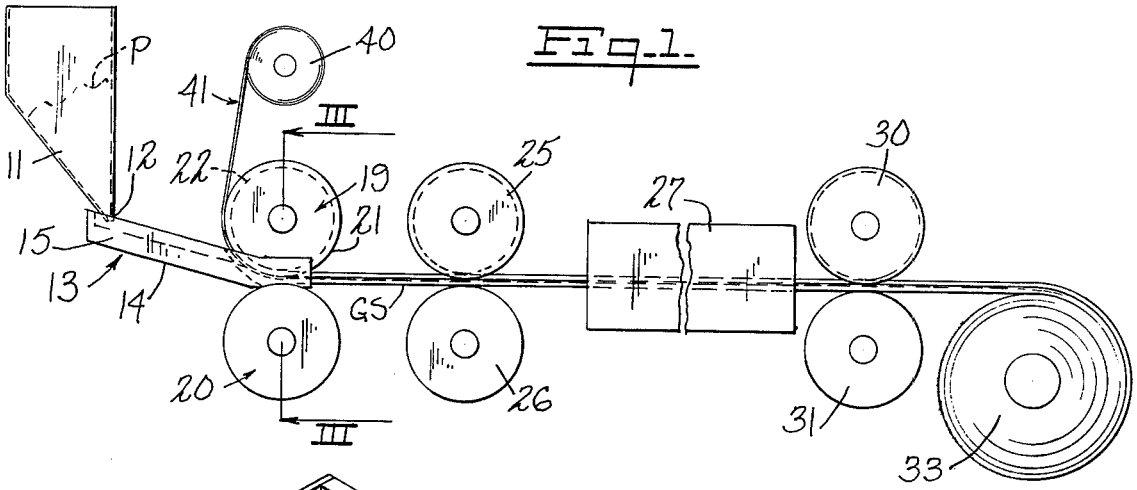
FIG. 1 represents a side elevation of certain basic mill elements set up to produce a metal strip or shape from powdered metal, the powdered metal being fed in at one end and the progression being substantially horizontal.
Figure 2:
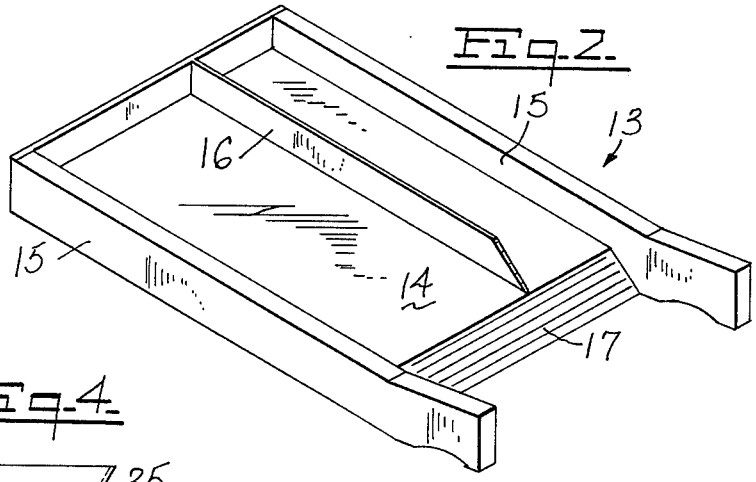
FIG. 2 represents a detail perspective view of a feeding tray adapted to guide the powdered metal to respective zones of the first rolls.
Figure 4:
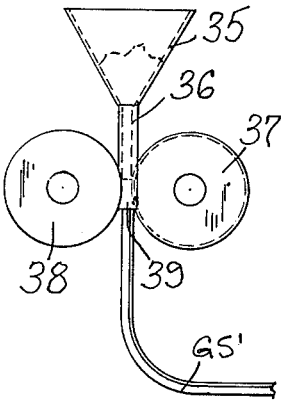
FIG. 4 represents a side elevation of a supply bin, chute and first rolls arranged for feeding vertically downward, as an alternative to the horizontal feed of FIG. 1
Figure 5:
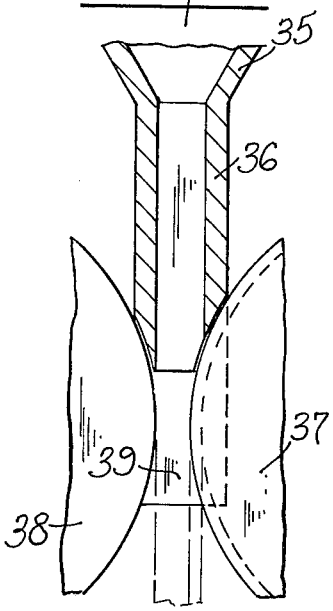
FIG. 5 represents a detail elevation as in FIG. 4, the chute being shown in section and parts being broken away.

As an alternative to the horizontal feed of FIG. 1, the first steps of the method may include supplying the metal powder from a bin or hopper 35 (FIG. 4) in a metered manner through a chute 36, which may include a gate, not shown, to the nip of the rolls 37, 38, which may be identical with the rolls 19, 20. End walls 39 of the chute should extend beyond the zone of maximum compression to confine the powder laterally to the exact cross-section desired, as in the case of the tray sides 15 in FIG. 1. The compacted green strip GS' exiting downward from the rolls 37, 38 may be treated in the same manner as the strip GS in FIG. 1 while traveling downward or after turning to a horizontal path, as may be found convenient. That is, the strip may be given a roll pass through rolls such as 25 and 26 mounted below the rolls 37, 38 before turning to a horizontal path and entering the sintering furnace, or the turn indicated in FIG. 4 may be made after the initial compacting by rolls 37, 38, or all the steps of the method can be carried out in a straight descending path.

It is frequently necessary to provide a stripe of another metal on one surface of a strip or shape. In accordance with the present method a reel 40 of the stripe material 41, in ribbon form, is located adjacent the compacting roll 19 and the stripe is fed into the nip of the campacting rolls where it becomes part of the green strip, retaining its ribbon character on the surface of the strip throughout the several steps of the method.

The spacing of the rolls and thickness of the strip is exaggerated in FIG. 3 for convenience of illustration. One example of a strip which may be made by the disclosed method is: copper alloy powder (Alloy C11600), compacted to a green strip 1.400 inch wide with dual thicknesses of 0.0635 inch and 0.019, inch the thicker portion being 0.480 inch wide; the strip is sintered and rolled to thicknesses of 0.050 inch and 0.015, inch respectively, while maintaining the same widths, of the strip and of the thicker portion. This reduction, by passage through one or more pairs of post-sintering rolls 30, 31 involves substantially equal percentage reductions in both sections, so that the final density is substantially uniform.

In a second example, a copper-nickel-tin alloy powder (Alloy C72500) is compacted with a 24K gold over nickel ribbon precisely placed in the surface of the thin section, the composite strip being compacted and sintered to a size 1.250 wide with dual thicknesses of 0.0575 inch and 0.020, inch the thicker portion being 0.920 inch wide; this is then rolled with an in-process anneal to thicknesses of 0.020 inch and 0.007 inch respectively, while maintaining the same width of the strip and of the thicker portion, the percent reduction in both sections being substantially equal and the lateral location of the gold stripe being unchanged.

If a strip having more than two sections of different thickness is required, it can be made by altering correspondingly the profile of one compacting roll 19 to provide as many portions having different diameters as the profile of the strip requires; the feeding of the metal powder being proportioned correspondingly by means of a tray or chute suitably subdivided and a metering gate. If the strip is to have surface discomformaties on both sides, instead of having one flat surface as shown, the second compacting roll 20 may be profiled as required instead of being a smooth cylinder.

In rolling a bar or wire to produce a strip having one or more thicknesses the metal flow is necessarily lateral, to a great extent, and the wider the strip becomes the greater is the tendency of its edges, particularly thin edges, to become wavy or "frilled." Taking this into account, it is customary to trim off all material which is not satisfactorily flat. This wastage is eliminated according to the present method, wherein there is little or no lateral flow, the movement of the metal grains in the compacted and sintered strip being essentially in the thickness mode, during rolling, until maximum density is achieved. Any elongation which may take place does not affect the integrity of the profile of the strip, or the precise control of its dimensions by the rolls through which it passes.

It will thus be seen that the objects set forth above, among those made apparent from the preceding description, are attained efficiently and, since certain changes may be made in carrying out the above method without departing from the spirit and scope of the invention, it is intended that all matter contained in the above description shall be interpreted as illustrative and not in a limiting sense.

What I claim:

1. The method of producing a continuous multigage roll-formed strip or shape from powdered metal in a generally rectangular cross-sectional configuration comprising (a) roll compacting a suitable powdered metal between a set of opposed rolls, one of said rolls having an asymmetrically stepped diameter, to an intermediate configuration having at least one uniformly thicker portion and at least one uniformly thinner portion, said thinner portion having no thickness as great as that in the thicker portion;

(b) sintering said compacted powdered metal multigage strip at a temperature and time suitable for the powdered metal alloy involved; and (c) further rolling both thicker and thinner portions of the sintered strip with rolls proportioned to effect substantially equal percent reductions in both thicker and thinner portions.

2. The method of claim 1 which includes compacting the powdered metal between rolls both of which have stepped diameters.

3. The method of claim 1 which includes feeding the metal powder to the compacting rolls at rates proportional to the areas of the nip between the rolls at the points where the powder enters said nip.

4. The method of claim 1 which includes maintaining the width of the strip substantially constant.

5. The method of claim 1 which includes rolling at least one pre-formed metal stripe into at least one surface of the strip at the compacting rolls.

* * * * *